United States Patent [19]

Baron et al.

[11] 4,402,360

[45] Sep. 6, 1983

[54] RETAINER FOR HEAT EXCHANGER CLEANING ELEMENTS

[75] Inventors: Walter J. Baron; Laird C. Cleaver, both of Milwaukee, Wis.

[73] Assignee: Water Services of America, Inc., Milwaukee, Wis.

[21] Appl. No.: 324,457

[22] Filed: Nov. 24, 1981

[51] Int. Cl.[3] ..... F28F 7/00; F28G 15/02

[52] U.S. Cl. ..... 165/76; 165/95; 15/104.06 A; 122/379

[58] Field of Search ..... 165/158, 76, 95; 122/379; 15/35, 104.06 A

[56] References Cited

U.S. PATENT DOCUMENTS

| | | | |
|---|---|---|---|
| 1,795,348 | 3/1931 | Schmidt | 165/95 |
| 3,319,710 | 5/1967 | Heeren et al. | 165/95 |
| 4,124,065 | 11/1978 | Leitner et al. | 165/95 |
| 4,353,414 | 10/1982 | Leitner | 165/95 |

FOREIGN PATENT DOCUMENTS

| | | | |
|---|---|---|---|
| 2817992 | 8/1979 | Fed. Rep. of Germany | 165/95 |

*Primary Examiner*—William R. Cline
*Assistant Examiner*—Theophil W. Streule, Jr.
*Attorney, Agent, or Firm*—Andrus, Sceales, Starke & Sawall

[57] ABSTRACT

A heat exchanger has a plurality of fluid flow tubes through which shuttle type cleaning elements are carried by the fluid, the direction of which is reversable. The cleaning elements are captured adjacent the tube ends by a transverse plate having cleaning element receiving openings therein. The plate is adapted to be mounted so that the openings register with the tube ends, and the plate openings are of sufficient length to contain the cleaning elements. At least some of the plate openings are connected by fluid flow slots which also communicate with the end chamber of the heat exchanger. A cleaning element stop device is disposed at the outer ends of the plate openings so that the cleaning elements are retained therein.

11 Claims, 5 Drawing Figures

FIG.1
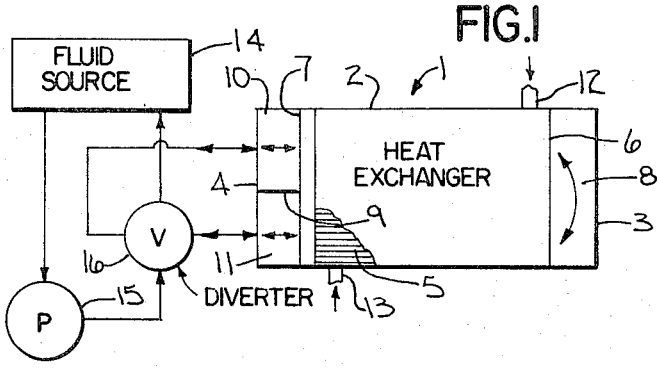
FIG.2
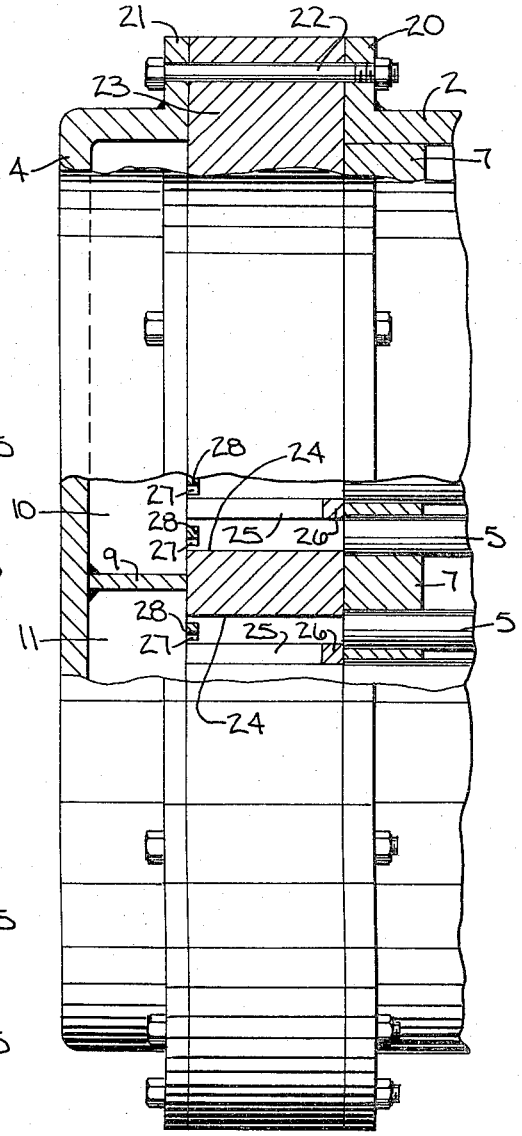
FIG.3
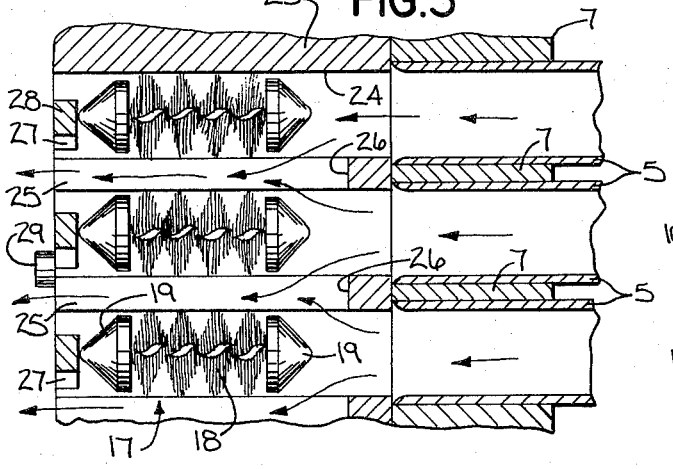
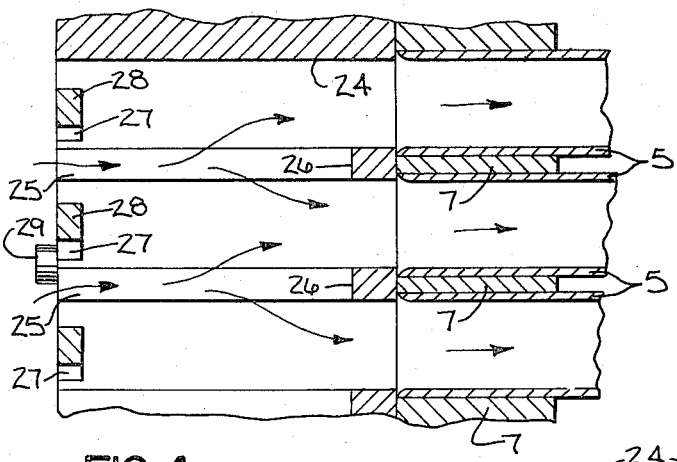
FIG.4
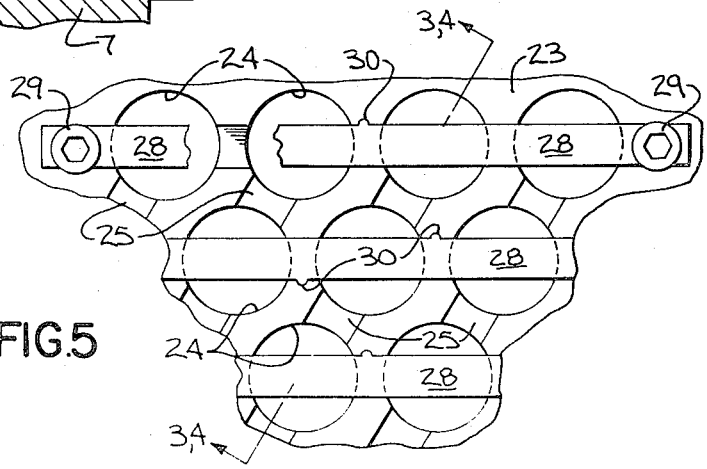
FIG.5

RETAINER FOR HEAT EXCHANGER CLEANING ELEMENTS

U.S. PRIOR ART OF INTEREST

| U.S. Pat. No. | Inventor | Issue Date |
|---|---|---|
| 3,319,710 | Heeren et al | May 16, 1967 |
| 4,124,065 | Leitner et al | Nov 7, 1978 |

BACKGROUND AND SUMMARY OF THE INVENTION

This invention relates to a retainer for heat exchanger heating elements.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttlable cleaning elements such as brushes. Fluid flowing in one direction through the tubes keeps the cleaning elements captured within their respective basket chambers, while the fluid discharges outwardly through slot-like openings in the basket walls. Upon reversal of fluid flow, the cleaning elements are forced out of their baskets and through the tubes to the baskets at the opposite tube ends to thereby perform a tube cleaning action.

In most prior constructions, each end of the heat exchanger housing has been provided with an outwardly extending peripheral flange which is secured to a mating flange disposed on a removable head member which closes the housing end and forms a fluid flow chamber. The cleaning element baskets are disposed within the chamber.

The baskets, which may be constructed of various materials, are of somewhat complex design and can be expensive to produce and install. The fact that many dozens of baskets may be needed in a large heat exchanger adds significantly to the manufacturing and assembly cost of the installation.

It is a task of the present invention to reduce the complexity of the mechanism for capturing and retaining the cleaning elements, and at the same time reduce costs.

In accordance with one aspect of the invention, the individual baskets are eliminated and replaced by a transverse plate having cleaning element receiving openings therein. The plate is adapted to be mounted so that the openings register with the tube ends, and the plate openings are of sufficient length to contain the cleaning elements.

In accordance with another aspect of the invention, at least some of the plate openings are connected by fluid flow slots which also communicate with the end chamber of the heat exchanger.

In accordance with yet another aspect of the invention, a cleaning element stop device is disposed at the outer ends of the plate openings so that the cleaning elements are retained therein.

BRIEF DESCRIPTION OF THE DRAWINGS

The accompanying drawings illustrate the best mode presently contemplated by the inventors for carrying out the invention.

In the drawings:

FIG. 1 is a schematic showing of a heat exchanger and fluid flow controls therefor;

FIG. 2 is an enlarged fragmentary side view of one end of a heat exchanger incorporating the various aspects of the invention, with parts broken away and in section;

FIG. 3 is a transverse section taken on line 3,4—3,4 of FIG. 5 and showing captured tube cleaning elements;

FIG. 4 is a section similar to FIG. 3 and also taken on line 3,4—3,4 of FIG. 4 with fluid flow reversed and the cleaning elements not present; and FIG. 5 is a fragmentary end view of the retainer plate.

DESCRIPTION OF THE PREFERRED EMBODIMENT

The present invention is directed to tube-type heat exchangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, cleaning elements 17 are normally disposed at one head end of the device and are adapted to shuttle back and forth in tubes 5 upon selective reversal of fluid flow by valve 16. Elements 17 may take any suitable form, such as the conventional brushes 18 having end caps 19.

In prior constructions, the ends of housing 2, and heads 3 and 4, have been provided with outwardly extending peripheral flanges 20 and 21 respectively which have been matingly joined together, as by bolts 22. Individual cleaning element retaining baskets have been connected to the ends of tubes 5 and disposed in chambers 8, 10 and 11.

In the present construction, the baskets are eliminated and replaced by a transversely extending integral unitary retainer plate 23 which is confined between housing flange 20 and head flange 21 and also secured in position against tube sheet 7 by bolts 22. Plate 23 is provided with a plurality of longitudinal openings 24 which are shown as extending therethrough. As shown, the inner ends of openings 24 register with the open ends of tubes 5, and are of sufficient length to contain cleaning elements 17.

As can be seen from FIGS. 3 and 4, the passages formed by openings 24 are adapted to connect the head end chamber with the interior of tubes 5 in a manner so that fluid flows laterally into or out of the passages. For this purpose, adjacent openings 24 are connected by longitudinal slots 25 which extend inwardly from the outer face of plate 23 and with the slots bottoming at 26 adjacent and inwardly of the plate's inner face. The longitudinal extent of slots 25 is thus shorter than that of openings 24. In the embodiment shown in FIG. 5, openings 24 are arrayed in parallel horizontal rows, with the openings in each row being slightly offset from the openings in an adjacent row. Slots 25 join generally vertically adjacent openings 24 and thus form a plurality of generally vertical parallel rows of slots.

Since openings 24 are shown as opening into the respective end head chambers of heat exchanger 1, stop means are provided on plate 23 to prevent cleaning elements 17 from continuing onwardly beyond plate 23 so that they would fall into the chamber during fluid flow in the direction shown by the arrows in FIG. 3. For this purpose, and in the present embodiment, the outer end portions of rows of openings 24 are joined by shallow grooves 27 which receive elongated stop rods 28 which are seated therein. Each stop rod 28 extends horizontally across the outer end portions of a plurality of openings 24 to be engaged by and block passage of cleaning elements 17 out of the openings, as shown in FIG. 3. Rods 28 intersect the generally vertical rows of slots 25, with the rod ends being threadably mounted to plate 23 as by cap screws 29. The rods may be peened, as at 30, in the conventional manner to hold them tightly within grooves 27 so they will not lift outwardly thereof in the rod midsections.

The concepts of the invention provide a simplified manner of retaining shuttling cleaning elements at the ends of heat exchanger tubing. Once heads 3 or 4 have been removed, the retaining means for all of the cleaning elements can be removed simultaneously merely be releasably sliding plate 23 off bolts 22. Assembly is equally as easy.

Various modes of carrying out the invention are contemplated as being within the scope of the following claims particularly pointing out and distinctly claiming the subject matter which is regarded as the invention.

We claim:

1. For use in a heat exchanger having a housing containing a plurality of fluid flow tubes arranged with exposed open ends adapted to communicate with a chamber formed by a housing head, and having a plurality of individual tube cleaning elements adapted to move through the tubes to clean them, the combination comprising:

(a) a member adapted to be disposed between the said housing and head and with said member forming a plurality of retaining means for capturing and holding the said plurality of tube cleaning elements, (b) and means for mounting said member to said housing, (c) said member being releasable from said mounting means so that all of said plurality of retaining means are removable simultaneously from the said housing.

2. The combination of claim 1:

(a) wherein said member comprises a plate disposable transversely of said housing and with said plate having a plurality of cleaning element receiving longitudinal openings adapted to register with the said fluid flow tubes, (b) and stop means disposed adjacent the outer end portions of said openings for engagement by the said tube cleaning elements, (c) said openings and said stop means forming said plurality of retaining means.

3. The combination of claim 2 wherein said plate has longitudinal fluid flow slots therein which join a plurality of said openings for communicating with the said chamber.

4. The combination of claim 3 wherein said slots are longitudinally shorter than said openings.

5. The combination of claim 2 wherein said stop means comprises an elongated stop rod extending across the outer end portions of said plurality of openings to block passage of the cleaning elements out of said openings.

6. The combination of claim 5 which includes means to mound said stop rod to said plate.

7. The combination of claim 5 wherein said plate includes shallow grooves joining a plurality of said openings and with said grooves having said rod seated therein.

8. The combination of claim 7 which includes means for holding said rod within said shallow grooves so that said rod is prevented from lifting outwardly thereof.

9. The combination of claim 7 wherein:

(a) said plate has longitudinal fluid flow slots therein which join a plurality of said openings for communicating with the said chamber, (b) and said openings are arrayed in rows and said slots extend between openings in adjacent opening rows to form rows of slots.

10. The combination of claim 9 wherein said stop rod intersects said rows of slots.

11. In a heat exchanger having a housing containing a plurality of fluid flow tubes arranged with exposed open ends adapted to communicate with a chamber formed by a housing head, and having a plurality of individual tube cleaning elements adapted to move through the tubes to clean them:

(a) a member disposed between said housing and said head and with said member forming a plurality of retaining means for capturing and holding said plurality of tube cleaning elements, (b) and means mounting said member to said housing, (c) said member being releasable from said mounting means so that all of said plurality of retaining means are removed simultaneously from said housing.

* * * * *